US006502490B1

(12) United States Patent
Krawick

(10) Patent No.: US 6,502,490 B1
(45) Date of Patent: Jan. 7, 2003

(54) MELON SLICER

(76) Inventor: Steven M. Krawick, 158 McConnell Rd., Loretto, PA (US) 15940

( * ) Notice: Subject to any disclaimer, the term of this patent is extended or adjusted under 35 U.S.C. 154(b) by 204 days.

(21) Appl. No.: 09/770,805

(22) Filed: Jan. 26, 2001

(51) Int. Cl.[7] ..... B26D 1/30

(52) U.S. Cl. ..... 83/247; 83/468.7; 83/607; 83/932

(58) Field of Search ..... 83/806, 454, 468.1, 83/468.6, 468.7, 932, 607, 609, 247, 268

(56) References Cited

U.S. PATENT DOCUMENTS

| | | | | | |
|---|---|---|---|---|---|
| 72,709 | A | * | 12/1867 | Williams | 83/468.7 |
| 1,041,221 | A | * | 10/1912 | Wyatt | 83/608 |
| 1,267,055 | A | * | 5/1918 | Cathcart | 362/89 |
| 1,998,383 | A | * | 4/1935 | Parodi | 83/468.7 |
| 3,183,817 | A | * | 5/1965 | Sausele | 396/549 |
| 3,596,354 | A | | 8/1971 | Emerson | |
| 3,780,436 | A | * | 12/1973 | Pellman | 30/123 |
| D375,661 | S | | 11/1996 | Ross | |
| 5,899,133 | A | * | 5/1999 | Halladay et al. | 83/608 |

* cited by examiner

*Primary Examiner*—Kenneth E. Peterson
*Assistant Examiner*—Phong Nguyen
(74) *Attorney, Agent, or Firm*—Ronald S. Lombard

(57) ABSTRACT

A device useful in slicing a melon is provided by the present invention. The device includes an elongated stand for holding the melon in a detachable cutting station with a cutting blade member and a movable butt plate that is adjustable to provide melon slices of the desired width. The device includes a blade retaining member to keep the blade member in an upright position while the melon is moved forward after each slice to contact the butt plate. The device is easily adaptable for both left handed and right handed operation. The device is especially useful for making transverse slices of the desired width of elongated melons such as a watermelon in an efficient manner.

17 Claims, 6 Drawing Sheets

MELON SLICER

BACKGROUND OF THE INVENTION

The present invention relates to a device useful in slicing a melon and, in particular, to a device that cradles the melon while it is being sliced. It is well known to anyone who has sliced a melon such as a watermelon due to the size and weight of the melon it is often difficult to position the melon for slicing and difficult to maintain the melon in position while slicing. It is often desirous to have uniform width of the melon slices and this has been difficult to achieve in the past.

A watermelon-handling utensil is disclosed in U.S. Pat. No. 3,596,354 dated Aug. 3, 1971, issued to Ralph W. Emerson. The Emerson watermelon-handling utensil includes a watermelon-containing housing having sidewalls at the bottom. Upwardly projecting tines are secured to the bottom for retaining a whole, uncut watermelon in the housing. An elongated cutting device that has one of its ends pivotally secured in a track extends across the central portion of the bottom of the housing. Retaining clips are provided for holding serving trays to one of the sidewalls. The Emerson utensil utilizes the elongated cutting device to longitudinally cut the melon, and, it is apparent, for the next and successive cuts the melon is rotated to divide the melon into the number of longitudinal slices desired. In U.S. Pat. No. DES 375,661, dated Nov. 19, 1996, issued to Gregory J. Ross et. al. is disclosed a design for a watermelon slicer where apparently the width of the slices are fixed.

SUMMARY OF THE INVENTION

The present invention provides a device useful in slicing a melon, such as a watermelon and the like, and, in particular, a device especially useful for making transverse slices of the desired width in an efficient manner. An elongated stand including a pair of oppositely disposed longitudinal horizontal melon retaining rails of equal length are provided. The elongated stand also includes transverse melon supporting members affixed to the pair of horizontal retaining rails. Support stand leg members are attached to the horizontal melon retaining rails in supportive relationship therewith. A melon cutting station assembly is provided. The cutting station assembly is engageable with the pair of melon retaining rails. The cutting station includes a pair of parallel longitudinal horizontal cutting station retaining rails of equal length. A pair of cutting station rails are in coaxial alignment with a pair of melon retaining rails.

A first of the cutting station rails has first cutting station leg members affixed thereto in supportive relationship therewith. Likewise, the second of the cutting station rails has the second cutting station leg members affixed thereto in supportive relationship. A cutting blade member support and retaining bracket is included that is attached to a first adjoining pair of the first cutting station leg members. A first cutting station rail has a first opening therethrough in predetermined position between the first pair of the first cutting station leg members. The cutting device bracket has a first slot therein in vertical alignment with the first cutting station rail opening.

A blade end receiving and supporting bracket is attached to a second adjoining pair of the second cutting station leg members opposite the first adjoining pair of the first cutting station leg members. The second cutting station rail has a second opening therethrough in predetermined position between the second pair of the second cutting station leg members. The blade end receiving and supporting bracket has a second slot therein in transverse alignment with the first slot of the cutting blade bracket and the second opening of the cutting station rail. An elongated cutting blade member is provided including a base pivotally mounted at one end thereof to the cutting blade bracket and operatively aligned with the first opening of the first cutting station rail and the second opening of the second cutting station rail. The cutting blade member includes a central cutting portion and a handle is affixed to the other end of the elongated cutting device.

A slice width adjustment assembly is provided including a transverse slice width adjustment support assembly attached between the first cutting station rail and the second cutting station rail. A frame is affixed to the slice width adjustment support member. The frame includes a central member having a threaded jackscrew aperture passing therethrough. A jackscrew is provided in operable engagement with the central member at the jackscrew aperture. A movable melon butt plate is also included in operable engagement with the jackscrew.

Utilizing the present invention, with the cutting blade in an upright position, a melon to be cut may be placed on the stand so that a portion of the melon contacts the movable melon butt plate. The jackscrew may be adjusted to obtain the desired slice width. The blade is then used to cut a first slice. The first slice is removed and the blade is raised in an upright position and the remaining part of the melon may be pushed toward the butt plate until a portion contacts the butt plate, and this may be repeated until the melon is sliced into slices of the desired width.

The cutting blade member support and retaining bracket preferably further includes a blade retention bracket including a pair of cutting blade base retaining members affixed thereto. Preferably, the blade support and retaining bracket also includes a blade retaining member affixed to the bracket proximate the first slot.

The blade retaining member preferably contains a resilient block member having a vertical slot therethrough in alignment with the base of the cutting device, whereby the cutting device may be retained by the resilient block member in an upright position while the melon is moved forward to contact the butt plate for the next slice. Preferably the resilient block comprises hard rubber.

Preferably, the diameter of the ends proximate the elongated stand of the first and second cutting station rails are sized so that the cutting station rails may slideably engage the ends of the horizontal retaining rails. Preferably the ends of the horizontal retaining rails further include spring-loaded detent members affixed thereto. The ends of the first and second cutting station rails preferably are provided with apertures therethrough in predetermined position to receive the second spring-loaded detent members, whereby the cutting station may be affixed to the elongated stand or released from the stand as desired.

The retaining rails preferably further include a non-skid material affixed thereto, such as, neoprene. Also, preferably, the transverse melon supporting members are elliptically shaped and pliable. Desirably the bottoms of the support stand leg members and the cutting station leg members also have a non-skid material affixed thereto, such as, neoprene.

The cutting station assembly further includes a drip pan affixed between the first adjoining pair of the first cutting station leg members and the second adjoining pair of the second cutting station leg members. Preferably, the blade end receiving and supporting bracket further includes a resilient blade stop affixed to the bracket proximate the bottom of the second slot. Desirably the cutting blade bracket and the blade end receiving and supporting bracket are affixed to the cutting station leg members by cooperating pairs of bolts and nuts, for example, whereby the cutting blade bracket and the blade end receiving brackets may be quickly interchanged with one another to provide for either left hand or right hand operation of the cutting device.

The slice width adjustment assembly preferably further includes butt plate stabilizer members each comprising an extension member attached at one end to the central member of the slice width adjustment assembly. The extension member has at the other end thereof a hollow rod receiving member. A slidable rod passes through the hollow rod receiving member and has one end thereof attached to the butt plate. Preferably the jackscrew includes a flared-end portion proximate the butt plate. An end portion containment box is attached to the butt plate. The flared-end portion of the jackscrew is housed within the containment box, whereby upon turning the jackscrew the butt plate is caused to move inwardly or outwardly as desired until the desired thickness of the melon slice is achieved.

BRIEF DESCRIPTION OF THE DRAWINGS

For a better understanding of the invention reference may be had to the accompanying drawings exemplary of invention, in which.

BRIEF DESCRIPTION OF THE PREFERRED EMBODIMENTS

Figure 1:
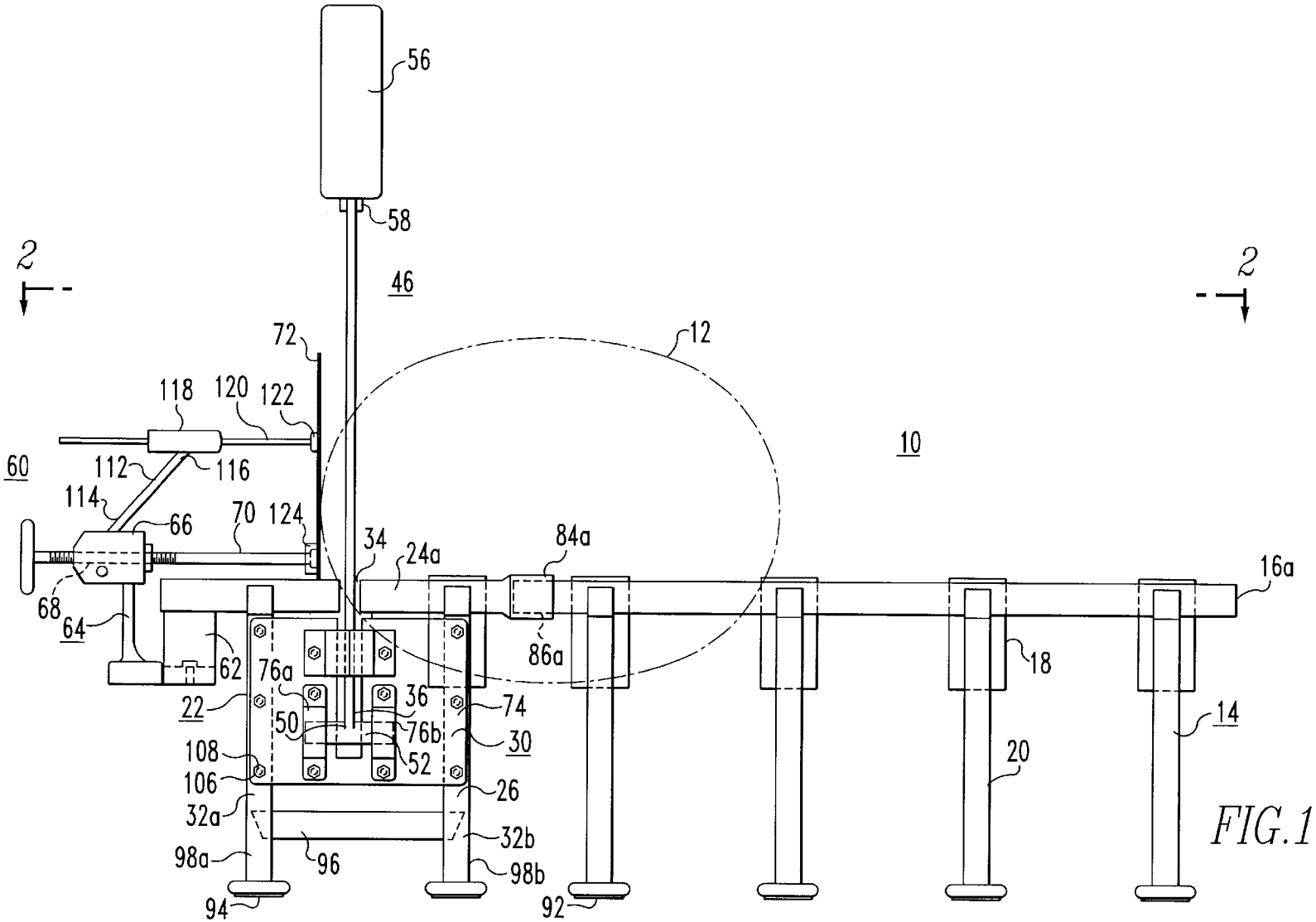
FIG. 1 is an elevational view of the slicing device of the present invention in operative position with a melon.

With reference to FIG. 1, there is shown a device 10 of the present invention useful in slicing a melon 12. The device 10 includes an elongated stand 14 including a pair of oppositely disposed longitudinal horizontal melon retaining rails 16*a*, 16*b* of equal length. Transverse melon supporting members 18 are affixed between the pair of horizontal retaining rails 16*a*, 16*b*. Support stand leg members 20 are affixed to the horizontal melon retaining rails 16*a*, 16*b* in supportive relationship therewith. A melon cutting station assembly 22 is provided engageable with the pair of melon retaining rails 16*a*, 16*b*.

Figure 2:
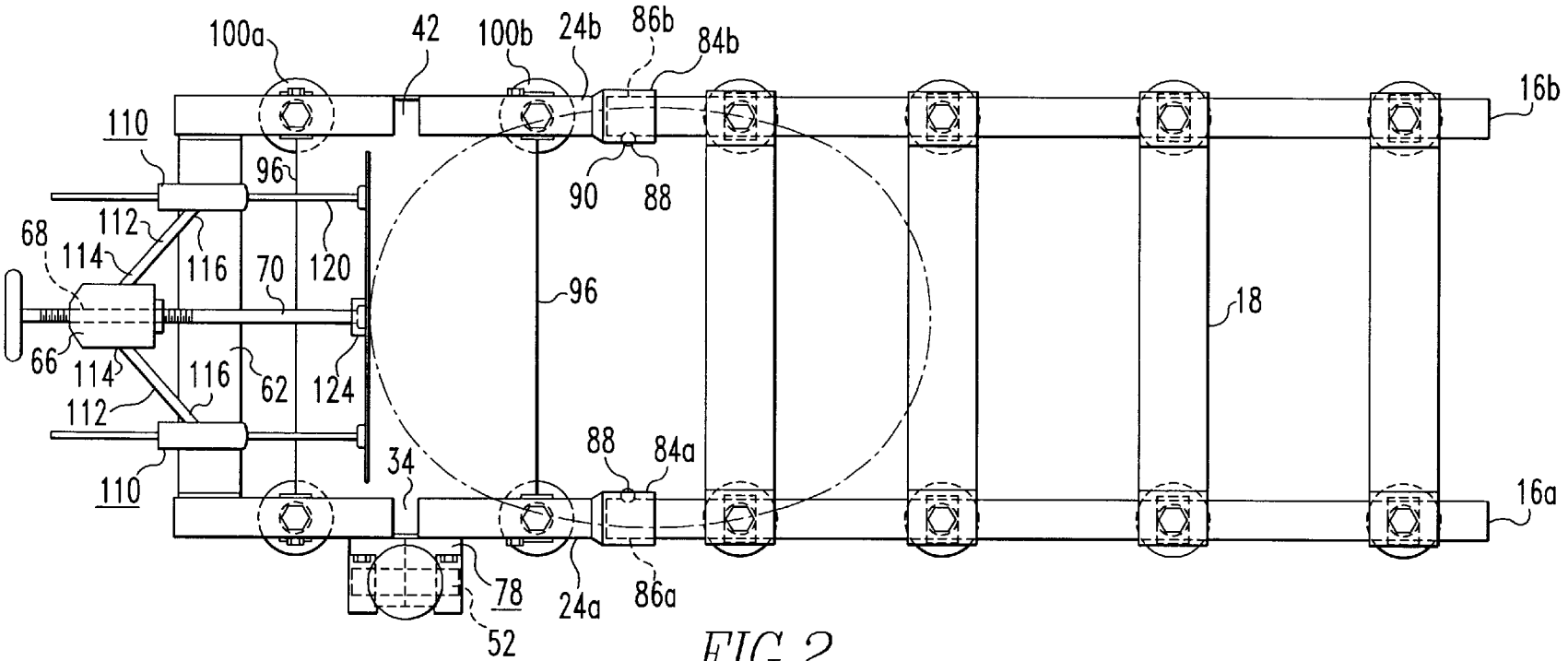
FIG. 2 is a top view of the slicing device in operative position as shown in FIG. 1.

The cutting station 22 includes a pair of parallel longitudinal horizontal cutting station retaining rails 24*a*, 24*b* of equal length. The pair of cutting station rails 24*a*, 24*b* are in coaxial alignment with the pair of melon retaining rails 16*a*, 16*b* as shown in FIGS. 1 and 2. A first of the cutting station rails 24*a* has first cutting station leg members 26 affixed thereto and in supportive relationship therewith. The second of the cutting station rails 24*b* has second cutting station leg members 28 affixed thereto in supportive relationship therewith. A cutting blade member support and retaining bracket 30 is attached to the first adjoining pair 32*a*, 32*b* of the first cutting rail 24*a* and has a first opening 34 therethrough in predetermined position as shown in FIG. 1 between the first pair 32*a*, 32*b* of the first cutting station leg members 26.

Figure 7:
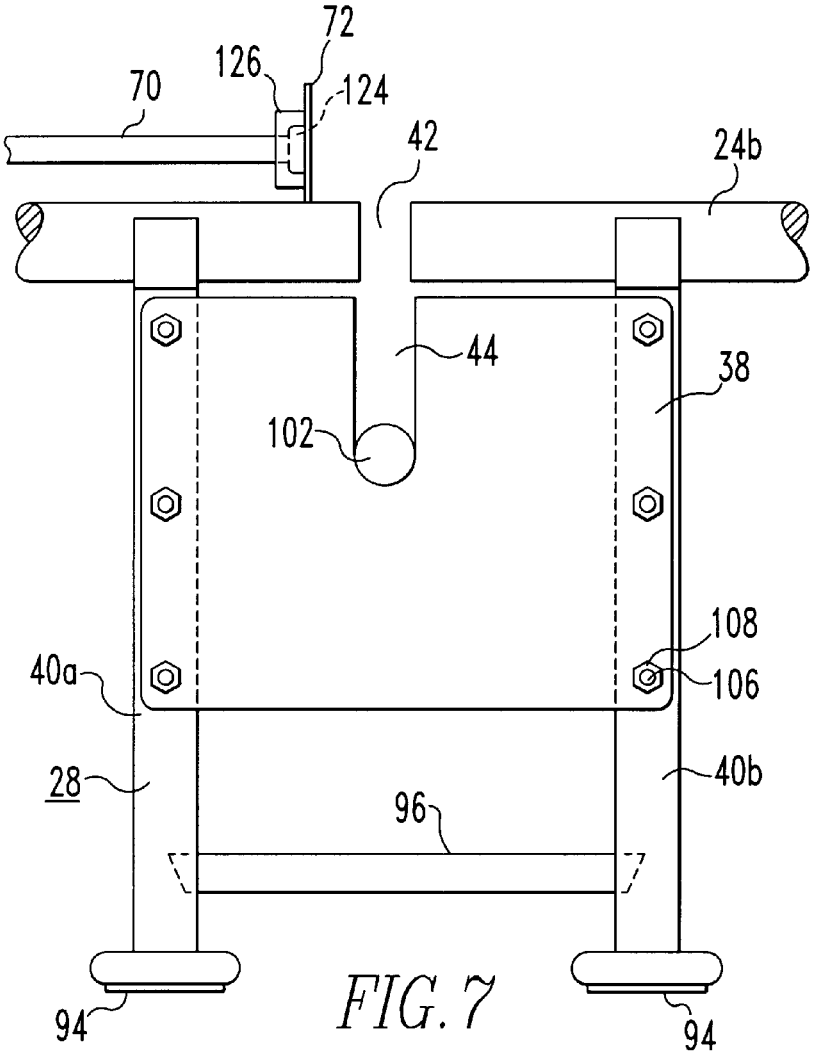
FIG. 7 is an elevational view of the blade end receiving and supporting bracket.

The cutting blade member support and retaining bracket 30 has a first slot 36 therein in vertical alignment with the first cutting station rail opening 34. Referring to FIG. 7, the blade end receiving and supporting bracket 38 is affixed to a second adjoining pair 40*a*, 40*b* of the second cutting station leg members 28 opposite the first adjoining pair 32*a*, 32*b* of the first cutting station leg members 26. The second cutting station rail 24*b* has a second opening 42 therethrough in predetermined position 40*a*, 40*b* of the second cutting station leg members 28. The blade end receiving and supporting bracket 38 has a second slot 44 therein in transverse alignment with the first slot 36 of the cutting plate member bracket 30.

Figure 3:
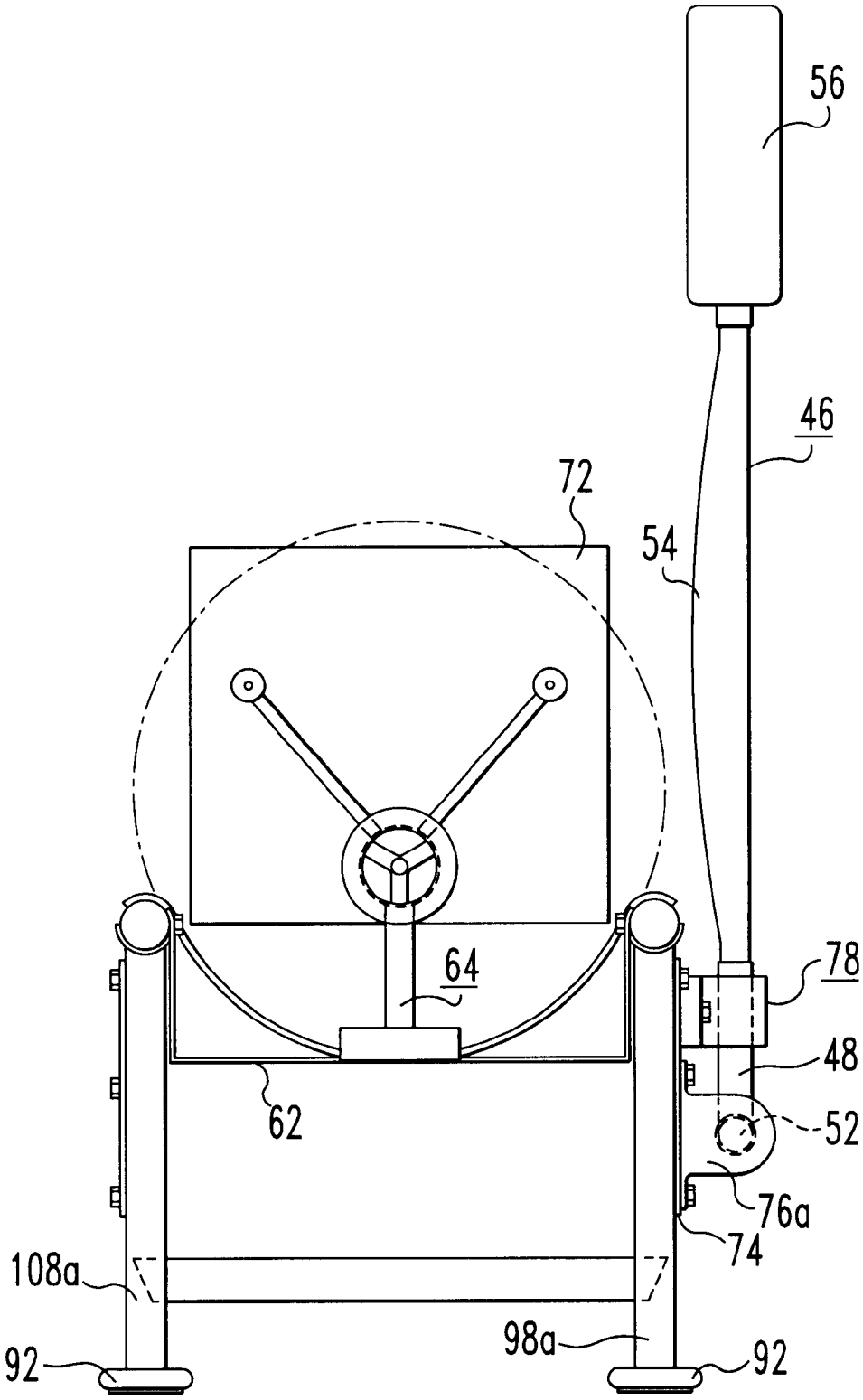
FIG. 3 is a side elevational view of the slicing device in operative position as shown in FIG. 1.
Figure 6:
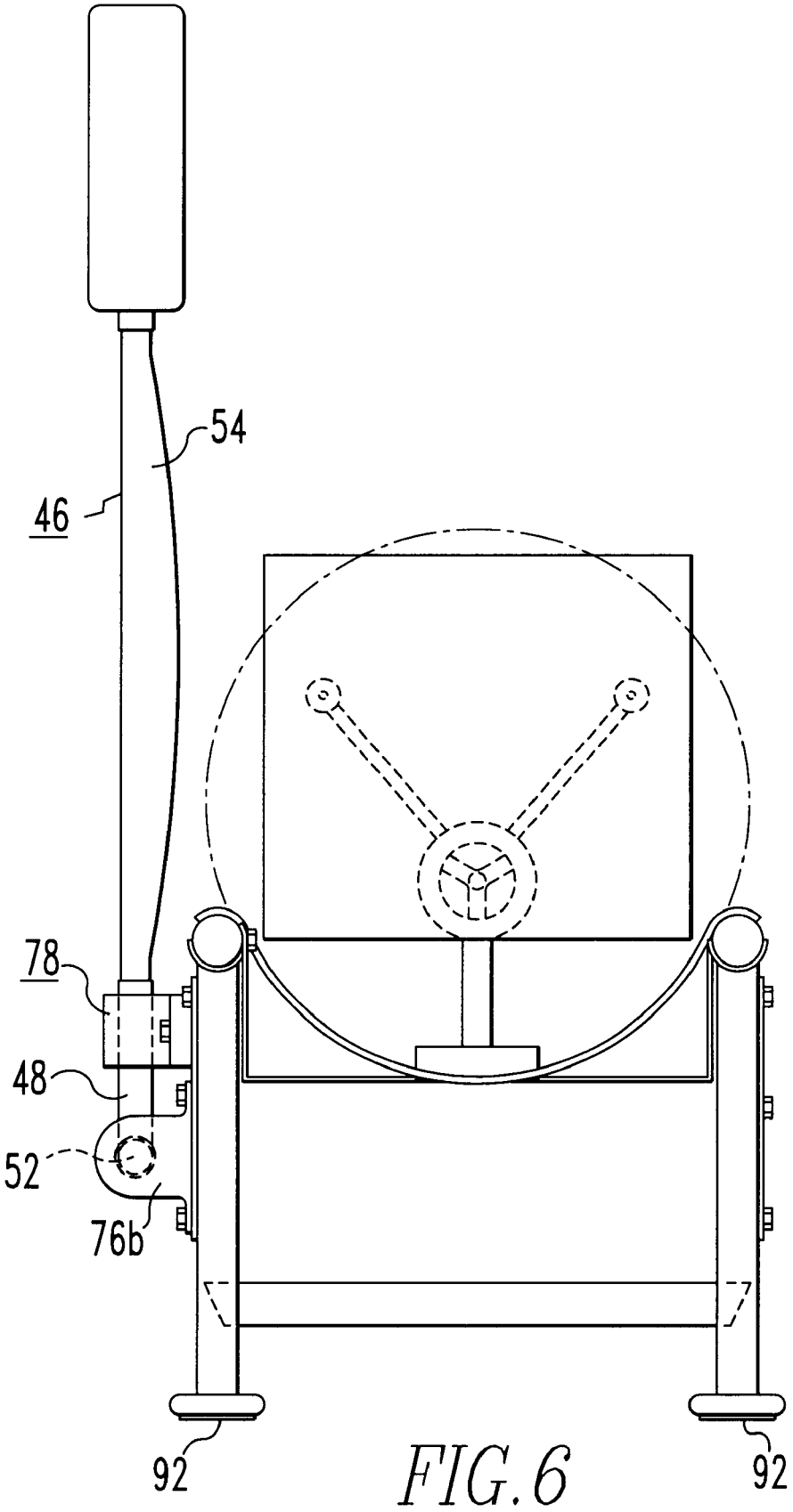
FIG. 6 is a side elevational view of the slicing device of the present invention showing the opposite end of the device shown in FIG. 3.

An elongated cutting blade member 46, as shown in FIGS. 1, 3 and 6, includes a base 48 pivotally mounted at one end 50 thereof to the cutting blade bracket 30. This can be seen in FIGS. 1 and 3, for example, the base of the cutting blade 48 includes a perpendicular cylindrical axle member 52. The cutting blade member 46 also includes a central cutting portion 54 and a handle 56 affixed to the other end 58 of the elongated cutting blade member 46. Slice width adjustment assembly 60 includes a transverse slice width adjustment support assembly 62 affixed between the first cutting station rail 24*a* and the second station rail 24*b* as shown in FIGS. 2 and 3, for example. A frame 64 is attached to the slice width adjustment support member 62. The frame includes a central member 66 having a threaded jackscrew aperture 68. A jackscrew 70 is in operable engagement with the central member 66 at the jackscrew aperture 68 as shown in FIGS. 1 and 2 for example. A movable melon butt plate 72 is provided in operable engagement with the jackscrew 70. To operate the device the jackscrew 70 is adjusted to obtain the desired melon slice width by changing the distance between the butt plate 72 and the cutting member 46. The cutting blade member 46 may be then used to cut a first slice. The first slice is removed and the cutting blade member 46 is raised in an upright position as shown in FIG. 1 and the remaining part of the melon may be pushed towards the butt plate until a portion contacts it and the process may be repeated until the entire melon is sliced into slices of the desired width. As can be seen from FIG. 1, where the outline of the melon is dashed and indicated by numeral 12, the melon such as a watermelon, for example, lies on the device 10 with its longitudinal axis parallel to the horizontal melon retaining rail 16*a*, 16*b*. It is apparent from this that the device is particularly suited to making transverse melon slices rather than longitudinal especially in the case of an elongated melon such as a watermelon.

Preferably the cutting blade member support and retaining bracket 30 as shown in FIG. 1 also includes a blade receiving and supporting bracket base 74 and a pair 76*a*, 76*b* of cutting blade base retaining members affixed to the bracket base 74 which is shown in FIG. 1 retain the cylindrical axle 52 of the base 48 for the elongated cutting blade 46 and which allows pivotal movement of the cutting plate. The blade support and retaining bracket 30 also desirably includes a blade retaining member 78 attached to the bracket base 74 proximate the first slot 36. The blade retaining member 78 desirably comprises a resilient block member 80 having a vertical slot 82 therethrough as shown in FIG. 5.

Figure 5:
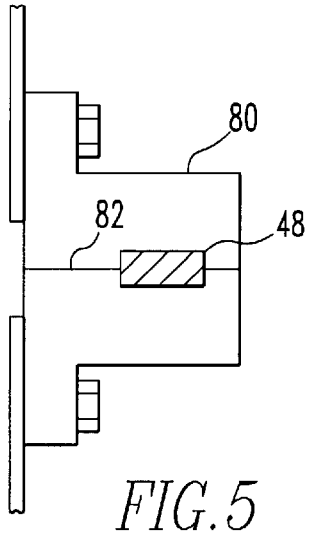
FIG. 5 is a cross sectional view taken along the line 5—5 of FIG. 4.
Figure 4:
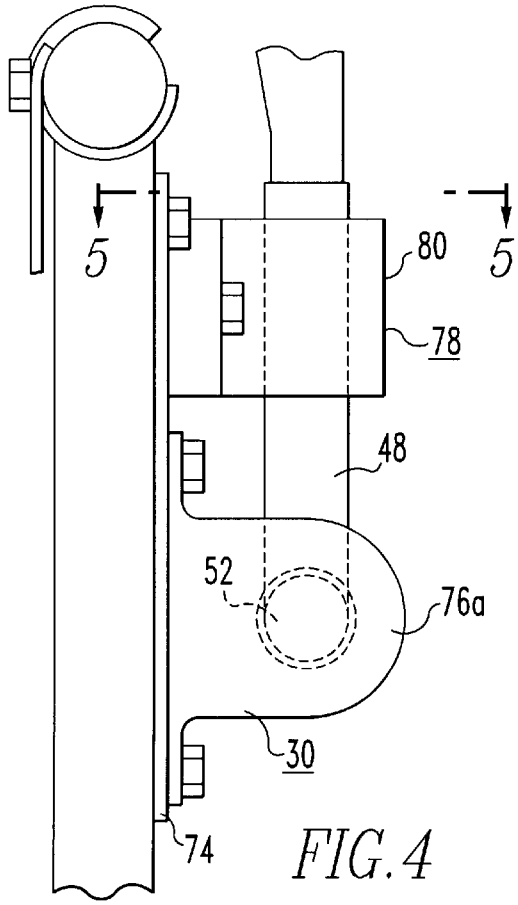
FIG. 4 is a side elevational view of the cutting blade member support and retaining bracket with the cutting blade member being in retained position with the blade retaining member.

The vertical slot 82 is sized to snuggly hold and receive the blade member base 48 and it is aligned with it as shown in FIG. 5, for example. This allows the cutting blade member 46 to be retained by the resilient block member 80 in an upright position as shown in FIGS. 1 and 4, for example, to permit the melon to be moved forward to contact the butt plate for the next slice. Preferably the resilient block member 80 comprises hard rubber.

The device 10 of the present invention preferably has the diameter of the ends 84*a*, 84*b* of the cutting station rails 16*a*, 16*b* respectively, sized so that the cutting station rails 24*a*, 24*b* may slideably engage the ends 86*a*, 86*b* of the horizontal melon retaining rails 16*a*, 16*b*, as shown in FIG. 2. Preferably the ends 86*a*, 86*b* of the horizontal retaining rails includes spring-loaded detent members 88 which are attached to the rail 16*a*, 16*b* and cooperate with apertures 90 provided in the ends 84*a*, 84*b* of the cutting station rails 24*a*, 24*b* and positioned to receive the spring-loaded detent members 88 so that the cutting station may be removed for storage or cleaning and then reattached to the elongated stand 14 as desired.

Preferably the melon retaining rails 16*a*, 16*b* include a non-skid material affixed to the surface thereof such as neoprene. Also it is desirable that the transverse melon support members 18 have an elliptical shape and are pliable, which may be made of neoprene, for example. Also the bottoms 92 of the support stand leg members 20 and the bottoms 94 of the cutting station leg members 26 have a non-skid material such as neoprene, adhered to the bottoms 92, 94. The cutting station assembly 22 also desirably includes a drip pan 96 attached between the first adjoining pair 98*a*, 98*b* of the first cutting station leg members 26 and the second adjoining pair 100*a*, 100*b* of the second cutting station leg members 28, as shown in FIGS. 1 and 2. This provides a receptacle for catching any juice from the melon as it is sliced. The drip pan may be held by clips, not shown, for easy removal.

Preferably the blade end receiving and supporting bracket 38 is provided with a resilient blade stop 102 as shown in FIG. 7. The resilient blade stop 102 is affixed to the bracket 38 proximate the bottom 104 of the second slot 44 as shown in FIG. 7. The resilient blade stop 102 may be made of hard rubber for example. Preferably the cutting blade bracket 30 and the blade end receiving and supporting bracket 38 are attached to the cutting station leg members 26, 28 with cooperating pairs of bolts 106 and nuts 108. This permits the cutting blade bracket 30 and the blade end receiving and supporting bracket to be quickly interchanged with one another to provide for either left hand or right hand operation of the cutting blade member 46.

Figure 8:
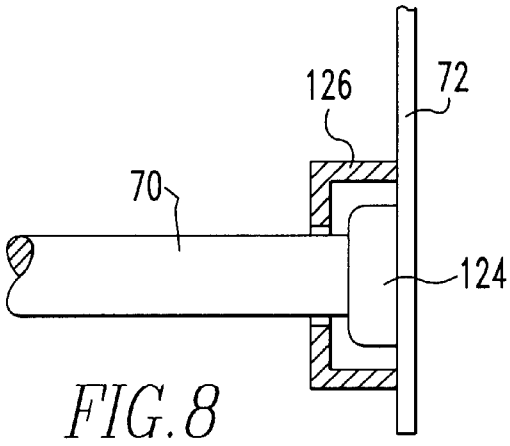
FIG. 8 is a side elevational view partly in section of the flared end portion of the jackscrew housed within the end portion containment box affixed to the butt plate.

The slice width adjustment assembly 60 further includes butt plate stabilizer members 110 each including an extension member 112 attached at one end 114 to the central member 66 of the slice width adjustment assembly 60. The extension member 112 has at the other end 116 a hollow rod receiving member 118. A slidable rod 120 passes through the hollow rod receiving 118 and has one end 122 thereof attached to the butt plate 72. Preferably the jackscrew 70 includes a flared end portion 124 as shown in detail in FIG. 8 proximate the butt plate. An end portion containment box 126 is attached to the butt plate 72 with the flared end portion 124 of the jackscrew 70 as shown in FIG. 8 is housed within the containment box 126 whereby upon turning the jackscrew 70 the butt plate is caused to move inwardly or outwardly as desired until the desired thickness of the melon slice is achieved.

What is claimed is:

1. A device useful in slicing a melon comprising:

an elongated stand including a pair of oppositely disposed longitudinal horizontal melon retaining rails of equal length, transverse melon supporting members affixed to said pair of horizontal retaining rails, support stand leg members affixed to said horizontal melon retaining rails in supportive relationship therewith, a melon cutting station assembly engageable with said pair of melon retaining rails, said cutting station including a pair of parallel longitudinal horizontal cutting station retaining rails of equal length, said pair of cutting station rails in coaxial alignment with said pair of melon retaining rails, a first of said cutting station rails having first cutting station leg members affixed thereto in supportive relationship therewith, the second of said cutting station rails having second cutting station leg members affixed thereto in supportive relationship therewith, a cutting blade member support and retaining bracket affixed to a first adjoining pair of said first cutting station leg members, said first cutting station rail having a first opening therethrough in predetermined position between said first pair of said first cutting station leg members, said cutting blade member support and retaining bracket having a first slot therein in vertical alignment with said first cutting station rail opening, a blade end receiving and supporting bracket affixed to a second adjoining pair of said cutting station leg members opposite said first adjoining pair of said first cutting station leg members, said second cutting station rail having a second opening therethrough in predetermined position between said second pair of said second cutting station leg members, said blade end receiving and supporting bracket having a second slot therein in transverse alignment with said first slot of said cutting blade member bracket, an elongated cutting blade member including a base pivotally mounted at one end thereof to said cutting blade bracket and operatively aligned with said first and said second openings, said cutting blade member also including a central cutting portion and a handle affixed to the other end of said elongated cutting blade member, a slice width adjustment assembly including a transverse slice width adjustment support assembly affixed between said first cutting station rail and said second cutting station rail, a frame affixed to said slice width adjustment support member, said frame including a central member having a threaded jackscrew aperture passing therethrough, a jackscrew in operable engagement with said central member at said jackscrew aperture, a moveable melon butt plate in operable engagement with said jackscrew, whereby with the cutting blade in an upright position, a melon to be cut may be placed on said stand so that a portion of the melon contacts said moveable melon butt plate, said jackscrew may be adjusted to obtain the desired slice width, said cutting blade member is then used to cut a first slice, the first slice is removed and said cutting blade member is raised in an upright position and the remaining part of the melon may be pushed towards said butt plate until a portion contacts it and this may be repeated until the entire melon is sliced into slices of the desired width.

2. The device of claim 1, wherein said blade support and retaining bracket further includes a blade receiving and supporting bracket base including a pair of cutting blade base retaining members affixed thereto.

3. The device of claim 2, wherein said blade support and retaining bracket further includes a blade retaining member affixed to said bracket base proximate said first slot.

4. The device of claim 3, wherein said blade retaining member comprises a resilient block member having a vertical slot therethrough sized to snugly hold and receive said blade member base and in alignment therewith, whereby said cutting blade may be retained by said resilient block member in an upright position while the melon is moved forward to contact said butt plate for the next slice.

5. The device of claim 4, wherein said resilient block member comprises hard rubber.

6. The device of claim 1, wherein the diameter of the ends of the cutting station rails proximate said horizontal melon retaining wall are sized so that said cutting station rails may slideably engage the ends of said horizontal retaining rails.

7. The device of claim 6, wherein said ends of said horizontal retaining rails further include spring-loaded detent members affixed thereto.

8. The device of claim 7, wherein said ends of said cutting station rails are provided with apertures therethrough in predetermined position to receive said spring-loaded detent members, whereby said cutting station may be affixed to said elongated stand or released from said stand as desired.

9. The device of claim 1, wherein said retaining rails further include a non-skid material affixed thereto.

10. The device of claim 1, wherein said transverse melon supporting members are elliptically shaped.

11. The device of claim 10, wherein said transverse melon supporting members are pliable.

12. The device of claim 1, wherein the bottoms of said support stand leg members and said cutting station leg members have a non-skid material affixed thereto.

13. The device of claim 1, wherein said cutting station assembly further includes a drip pan affixed between said first adjoining pair of said first cutting station leg members and said second adjoining pair of said second cutting station leg members.

14. The device of claim 1, wherein said blade end receiving and supporting bracket further includes a resilient blade stop affixed to said bracket proximate the bottom of said second slot.

15. The device of claim 1, wherein said cutting blade bracket and said blade end receiving and supporting bracket are affixed to said cutting station leg members with cooperating pairs of bolts and nuts, whereby said cutting blade bracket and said blade end receiving and supporting brackets may be quickly interchanged with one another to provide for either left hand or right hand operation of said cutting blade member.

16. The device of claim 1, wherein said slice width adjustment assembly further includes butt plate stabilizer members each comprising an extension member affixed at one end to said central member of said slice width adjustment assembly, said extension member having at the other end thereof a hollow rod receiving member, a slideable rod passing through said hollow rod receiving member and having one end thereof affixed to said butt plate.

17. The device of claim 1, wherein said jackscrew includes a flared end portion proximate said butt plate, an end portion containment box is affixed to said butt plate, said flared end portion of said jackscrew is housed within said containment box, whereby upon turning said jackscrew said butt plate is caused to move inwardly or outwardly as desired until the desired thickness of the melon slice is achieved.

* * * * *